US008511474B2

(12) United States Patent
Maunder

(10) Patent No.: US 8,511,474 B2
(45) Date of Patent: Aug. 20, 2013

(54) SYSTEMS AND METHODS FOR CLEANING A BATCH OF GRANULAR MATERIAL

(75) Inventor: Andrew Maunder, Greenwood, SC (US)

(73) Assignee: Prysmian Cavi E Sistemi Energia S.r.L., Milan (IT)

( * ) Notice: Subject to any disclaimer, the term of this patent is extended or adjusted under 35 U.S.C. 154(b) by 864 days.

(21) Appl. No.: 10/565,201

(22) PCT Filed: Jul. 21, 2003

(86) PCT No.: PCT/US03/22547

§ 371 (c)(1),
(2), (4) Date: Aug. 2, 2006

(87) PCT Pub. No.: WO2005/016561

PCT Pub. Date: Feb. 24, 2005

(65) Prior Publication Data

US 2007/0056882 A1 Mar. 15, 2007

(51) Int. Cl.
*B07B 15/00* (2006.01)

(52) U.S. Cl.
USPC ..... 209/44.2; 209/12.2; 209/576

(58) Field of Classification Search
USPC ..... 209/3, 3.1, 4, 12.2, 44.1, 44.2, 576–582
See application file for complete search history.

(56) References Cited

U.S. PATENT DOCUMENTS

| | | | | | |
|---|---|---|---|---|---|
| 1,732,463 | A * | 10/1929 | Fegles | ..... | 209/242 |
| 3,482,686 | A * | 12/1969 | Wood | ..... | 209/587 |
| 4,096,949 | A * | 6/1978 | Hoover et al. | ..... | 209/564 |
| 4,116,822 | A * | 9/1978 | Webb | ..... | 209/11 |
| 4,248,699 | A * | 2/1981 | Hukki | ..... | 209/710 |
| 4,448,680 | A * | 5/1984 | Wilks et al. | ..... | 209/564 |
| 4,631,124 | A * | 12/1986 | Paulson | ..... | 209/3 |
| 5,071,541 | A * | 12/1991 | Thompson | ..... | 209/2 |
| 5,201,576 | A | 4/1993 | Squyres | | |
| 6,355,897 | B1 | 3/2002 | Björk | | |
| 6,540,088 | B2 * | 4/2003 | Oder et al. | ..... | 209/218 |
| 6,817,474 | B2 * | 11/2004 | Ikeda et al. | ..... | 209/223.2 |
| 7,905,357 | B2 * | 3/2011 | Svatek et al. | ..... | 209/246 |
| 2003/0127366 | A1 | 7/2003 | Ikeda et al. | | |

FOREIGN PATENT DOCUMENTS

| | | |
|---|---|---|
| EP | 0 705 650 A2 | 4/1996 |
| GB | 2 033 881 A | 5/1980 |
| WO | WO 99/37412 | 7/1999 |

* cited by examiner

*Primary Examiner* — Joseph C Rodriguez
(74) *Attorney, Agent, or Firm* — Finnegan, Henderson, Farabow, Garrett & Dunner, L.L.P.

(57) ABSTRACT

An apparatus (100) and method cleans a batch of pellets or granules prior to use in an extrusion process. Loose contaminants having material characteristics that are undersired for the extruded product are first removed (110) from the batch using a deduster. The deduster may also remove uncontaminated fines and fluff from the batch. Pellets that are defective or otherwise undersired for the extrusion process as well as other loose particle contaminants can then be efficiently detected and removed (120) without the risks of fines clogging the apparatus or shielding the detection process. Magnets may help remove (130) particulates of ferrous material before or after the removal (120) of defective pellets. The resulting batch of pellets helps to produce extruded materials of higher quality, such as insulation material in electrical cables.

15 Claims, 3 Drawing Sheets

SYSTEMS AND METHODS FOR CLEANING A BATCH OF GRANULAR MATERIAL

FIELD OF THE INVENTION

The present invention generally relates to the field of removing contaminants from discrete solid materials. More particularly, the present invention relates to systems and methods for cleaning a collection of resin pellets used in extruding a polymer product, such as insulation in electrical cables.

BACKGROUND OF THE INVENTION

An electrical cable includes an insulation material between a conductor and the closest electrical ground, thus preventing an electrical fault. Generally, the insulation may be made of a crosslinked or non-crosslinked polymeric composition with electrical insulating properties chosen, for example, from: polyolefins (homopolymers or copolymers of various olefins), ethylenically unsaturated olefin/ester copolymers, polyesters, polyethers, polyether/polyester copolymers, and blends thereof.

Examples of polymers suitable for electrical cable insulation are polyethylene (PE), in particular linear low-density PE (LLDPE); polypropylene (PP); propylene/ethylene thermoplastic copolymers; ethylene/propylene rubbers (EPR) or ethylene/propylene/diene rubbers (EPDM); natural rubbers; butyl rubbers; ethylene/vinyl acetate (EVA) copolymers; ethylene/methyl acrylate (EMA) copolymers; ethylene/ethyl acrylate (EEA) copolymers; ethylene/butyl acrylate (EBA) copolymers; ethylene/α-olefin copolymers, and the like.

During electrical cable manufacture, the insulation material, as well as other material layers, are generally placed on the cable by extrusion. In an extrusion process, pellets comprising plastic resin or other materials are first loaded into a hopper and then fed into a thermoregulated barrel of an extruder. Within the barrel, the pellets are heated to the point of melting and moved along the barrel by the action of at least one continuously revolving screw. At the end of the barrel, the molten plastic is forced out through a die that is cast in the shape of the finished product to be obtained.

For purposes of this description, "pellets" refers generally to small particulates or granules of a material. Although "pellets" may connote an elliptical shape in some contexts, the extrusion pellets addressed in this description are not limited to a particular geometry. Consequently, pellets may be cylindrical, spherical, oblong, rectangular, square, or any other shape.

Devices are often employed to improve the condition of the resin pellets before extrusion of the insulation takes place. For example, devices may be used for removing residual resin material from a batch of the granular compound just before the pellets enter the extruder. This residual material is called "fines." For purposes of this description, "fines" are substances of the same material as the resin pellets but not having a granular or pelletized form. Also called "fluff" or "streamers," fines often are in the shape of strings, hair, or powder. Fines can clog machinery and degrade the throughput of the extruder. Although fines also can degrade the quality of the extruded polymer, for purposes of this description fines are not considered contaminants within the batch of material.

Devices called dedusters are conventionally used to remove fines and dust from a batch of granular resin material. When extruding electrical cable insulation, dedusters are typically employed at the input feed to the extruder. U.S. Pat. No. 4,631,124 is exemplary in describing the operation of a conventional deduster. It discloses a deduster that employs gravity to feed dust and impurity laden particulate material through a linear kinetic energy cell. The cell generates an electric field to neutralize the static electric charges that causes the dust to adhere to the particulate material. With the static electric charge neutralized, the dust (and fines) can be separated by an air flow substantially transverse to the particle flow. Removal of the impurities can be accomplished by pressurized air or a vacuum.

The remaining pellets can be extruded to form insulation for an electrical cable, for example. An electrical cable includes a cable core at its interior. In the present description, the term "cable core" indicates a semi-finite structure comprising a conductor and at least one layer of electrical insulation placed in a position which is radially external to said conductor. More particularly, when considering a cable for the transport or distribution of medium/high voltage electrical power, the cable core may further comprise an internal semiconductive layer (i.e. a conductor shield), an external semiconductive layer (i.e. an insulation shield), and a metal screen. The internal semiconductive layer is located in a position radially external to the conductor. The external semiconductive layer is located in a position radially external to the insulation. The metal screen is in a position radially external to the insulation shield.

To avoid stress-concentrating irregularities in the cable core, the conductor shield, the insulation, and an insulation shield may be applied simultaneously by co-extrusion. Generally, this is accomplished by a triple-output extrusion head in conjunction with automated scanning devices to monitor each layer for thickness and concentricity directly after the layers are applied. By monitoring the extrusion process, automatic controls may correct any variation in thickness or concentricity.

After the insulation is extruded onto the conductor, it is cured. With XLPE, for example, the curing process causes carbon atoms to link to adjacent polyethylene chains, resulting in cross-linking. Cross-linking improves the thermo-mechanical properties of the insulation. After the cable is cured in the tubes, it is taken up on large reels.

The insulation in an electrical cable may degrade for a number of reasons. For example, polyethylene is susceptible to degradation due to partial discharge that may in turn lead to "water treeing." Water treeing is the phenomenon whereby small tree-like voids form and grow in the insulation and may fill with water. If a tree grows large enough in the insulation, electrical breakdown, and thus cable failure, can occur between the conductor and an electrical ground.

In electrical cables, failure mechanisms, like water treeing, are more likely to occur when imperfections exist in the insulation layer. Imperfections in the insulation often result from contaminants within the batch of resin material used to extrude the insulation.

For purposes of this description, "contaminants" generally refers to particles having characteristics that are undesirable for the material being extruded. Contaminants might include, for example, metal, dirt, or just about any material different from the pellet material. However, some fines may be considered contaminants as well for purposes of this description. For example, as opposed to "clean fines," fines that have contaminants attached to them (known as "dirty fines") and fines that have become thermally degraded (known as "amber fines") often are discolored and can contaminate the resin batch.

Conventionally, it has been thought that most extrusion imperfections are caused by contaminants embedded within the resin pellets. Contaminants that are embedded within the pellets, generally referred to as defective pellets, can be difficult to identify and to separate from desired pellet materials.

Several approaches are known for generally separating defective pellets from desired pellets. In these approaches, "defective pellets" often include other deficiencies beyond just having contaminants embedded within them. For example, for some applications, extrusion pellets may be defective because they include air bubbles, contain material impurities, have differing geometries, or have differing colors. In general, conventional equipment for removing defective pellets is effective in removing pellets having embedded contaminants.

The first step in many of these approaches is to first feed the pellets onto a conveying belt. An endless driving belt may, for example, constitute the conveying belt. Thereafter, defective pellets that are conveyed on the conveying belt can be detected by using some sort of separation device.

Further details for separating defective discrete materials are described in EP 0 705 650 A2. In this application, a grain sorting apparatus comprises a conveyor belt mechanism for conveying grains. The grains are fed by a feed mechanism onto a conveying surface separately from each other at an upstream region with respect to a conveying direction. The grains are discriminated and sorted by a discriminating mechanism and a sorting mechanism when dropping from the downstream end along a predetermined path.

Another approach to material sorting is described in WO 99/37412. This application includes an arrangement for sorting pellets, comprising a transportation device for feeding the pellets. The device also includes a first container for faultless pellets fed over the end portion of the transportation device, a second container for defective pellets, a detector for detecting defective pellets and a sorting device for feeding any defective pellets detected to said second container.

In conventional sorting machines, the step of sorting defective pellets often occurs based on a comparison of their external appearance with a predetermined criteria using a light beam. Sorting based on the external appearance has some limitations, however, because accurate detection must be evenly carried out over the entire pellet. If defects exist inside a pellet due, for example, to an air bubble, then a sorting process limited to external criteria may not be thorough. Also, shadows and reflections from the light beam may be erroneously construed as defects in the external appearance. Consequently, this type of measurement is often very costly and complex.

U.S. Pat. No. 6,355,897 discloses an alleged improvement to pellet sorting using a device that includes a light detector arranged over a transparent pellet transport track. A light source is arranged on the opposite side of the track. The detector provides a measurement of a received light intensity, and if the measured intensity is lower than a predetermined threshold value, it can be assumed that a defect is present. The pellet containing the defect is then sorted out by actuating a sorting device. In order to obtain a high precision detection, light is distributed evenly from all directions, including ambient light.

In U.S. Pat. No. 5,201,576, a shadowless illumination system is disclosed that may include a spherical chamber having a chamber entrance opening and a chamber exit opening. The inside surface of the spherical chamber may be coated with highly reflective flat white paint. A clear rigid plastic cylindrical tube may be positioned in the spherical chamber between the chamber entrance and exit openings. A circular fluorescent ring lamp may be positioned inside the spherical chamber to form an annulus around the tube. The lamp and the white inside surface of the spherical chamber may provide shadowless illumination for articles that are dropped or otherwise projected through the tube. The articles may be inspected as they pass through the tube by at least two video inspection cameras that view opposite sides of the articles through respective viewing openings.

Applicant has noticed that these prior arrangements for filtering or cleaning resin pellets before extruding polymer products have proved to be insufficient to attain a high quality product. In particular, Applicants have noticed that upwards of 95% of the contaminants in a batch of resin material for extruding electrical cable insulation are loose particles, with 5% or less of the contaminants being embedded in the pellets. These loose contaminants may include particulate of just about any material, including insects, paper, fabric, metal, dirty fines, and amber fines. The presence of these loose contaminants mixed with the resin pellets complicates the cleaning process. While conventional pellet sorting machinery is often effective at removing pellets having embedded contaminants, they are less effective in removing loose particle contaminants, especially those that are small in size relative to the pellets.

Moreover, Applicant has observed that existing systems for removing pellets containing embedded contaminants do not sufficiently account for fines when sorting pellets. While some devices do provide for airflow around the detection device in order to move fines away from the pellets, Applicant has noticed that the airflow is insufficient to remove a significant amount of the fines. This situation leads to a build-up of fines that must be cleaned out often, creating an obstacle to continuous operation of the device.

SUMMARY OF THE INVENTION

Consistent with embodiments of the present invention, systems and methods for cleaning a compound that is in pellet form are provided that avoid problems associated with prior cleaning systems and methods.

In one aspect, a method provides for cleaning a batch of granular materials to be extruded into a product, where the batch includes pellets, defective pellets, and loose particles. According to the method, a portion of the loose particles are first removed from the batch. This step includes removing loose contaminants that are separable from both the pellets and the defective pellets, where the contaminants have material characteristics that are undesirable for the product. The removing of a portion of the loose particles from the batch may also include removing clean fines.

Next, the defective pellets and additional loose contaminants are detected in the batch, where the defective pellets contain contaminants embedded within them. Finally, the defective pellets and the additional loose contaminants are removed from the batch.

In the preferred method, further contaminants containing ferrous material may also be removed from the batch. The removal of further contaminants containing ferrous material may occur either before or after the defective pellets are removed from the batch. Preferably, a rare earth magnet enables removal of the further contaminants containing ferrous material.

In another aspect consistent with the present invention, an apparatus for removing contaminants from a collection of pellets intended for extruding a product, includes a deduster and a pellet sorter. The deduster has an input for receiving the collection and an output. The deduster is configured to remove unwanted particles from the collection and to discharge the collection at the output. The unwanted particles include clean fines and loose contaminants. The contaminants have material characteristics detrimental to the product.

The pellet sorter is coupled to the output of the deduster. It is configured to identify and remove at least additional loose contaminants and pellets containing contaminants embedded within them. Preferably, the apparatus further includes a passage between the deduster and the pellet sorter. This passage includes a cover to substantially prevent ambient particulates from mixing with the collection.

In a further aspect, an apparatus for cleaning a batch of materials intended for extruding a product includes a contaminant remover and a pellet sorter. The materials include a plurality of resin pellets, clean fines, and contaminants, where contaminants have material characteristics undesirable for the product. The contaminant remover is positioned in a stream of the materials and is configured to separate from the batch clean fines, contaminants unattached to the pellets, and contaminants electrostatically adhered to at least one of the pellets. The pellet sorter is positioned downstream of the contaminant remover and is configured to select and remove at least additional contaminants unattached to the pellets and contaminants adhered to at least one of the pellets. The apparatus may also include a magnet positioned in the stream.

Both the foregoing general description and the following detailed description are exemplary and are intended to provide further explanation of the invention as claimed.

BRIEF DESCRIPTION OF THE DRAWINGS

The accompanying drawings provide a further understanding of the invention and, together with the detailed description, explain the principles of the invention. In the drawings.

DETAILED DESCRIPTION OF THE PREFERRED EMBODIMENTS

Figure 1:
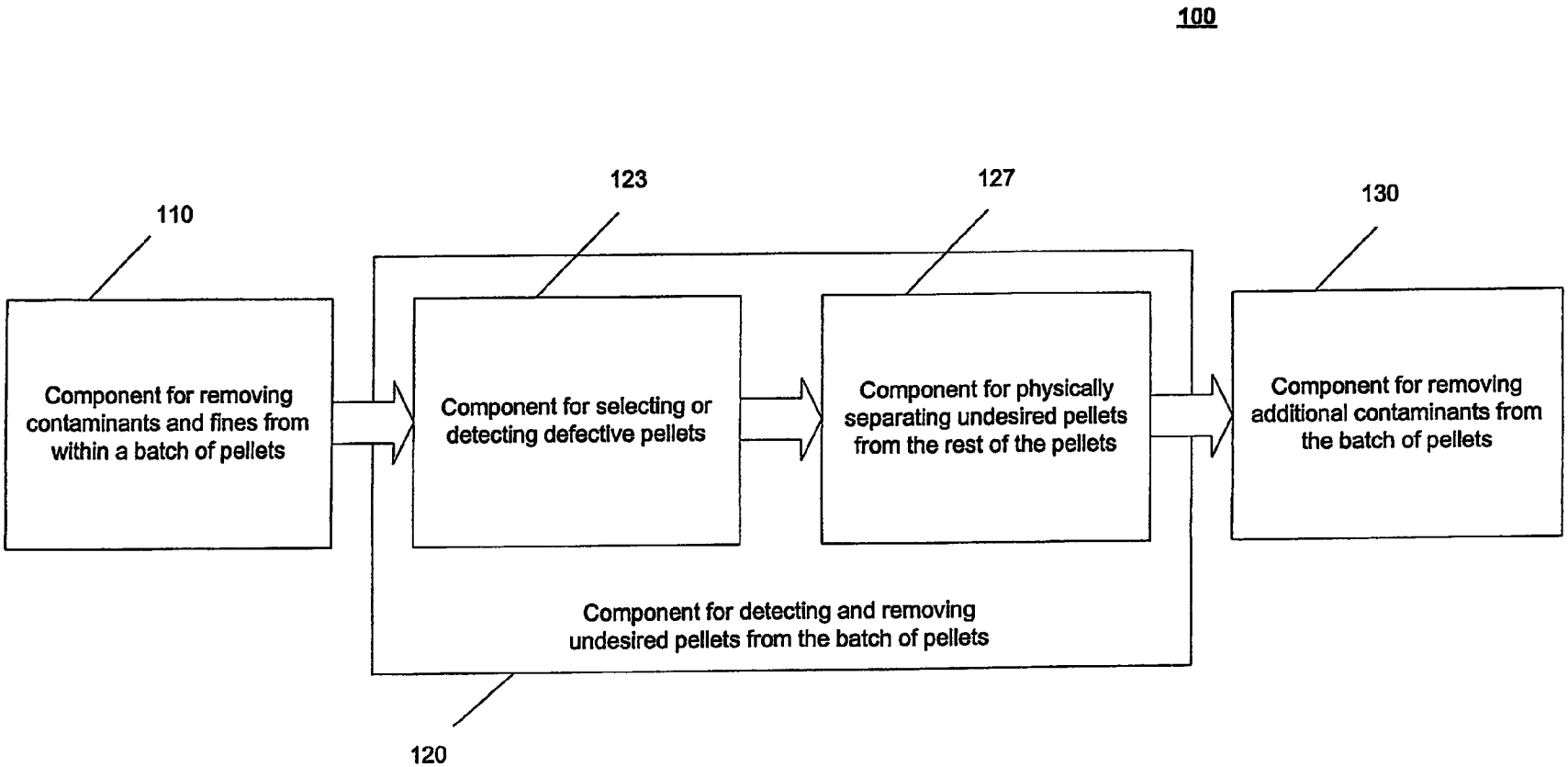
FIG. 1 is a functional block diagram of a system for cleaning a compound in the form of pellets consistent with an embodiment of the present invention.

Reference will now be made to various embodiments according to this invention, examples of which are shown in the accompanying drawings. In the drawings, the same reference numbers represent the same or similar elements in the different drawings whenever possible.

In accordance with preferred embodiments of the present invention, a method and apparatus for cleaning a batch of granular materials to be used in an extrusion process is applied to a batch that includes pellets, defective pellets, and loose particles. The pellets are desired for the extrusion process and typically are resin material for that purpose. The defective pellets and loose particles, however, are not desired for the extrusion process and are sought to be removed.

A portion of the loose particles are first removed from the batch. The removed loose particles include loose contaminants separable from both the pellets and the defective pellets. As discussed above, for purposes of this description, "contaminants" generally refers to particles having characteristics that are undesirable for the material being extruded. Contaminants might include, for example, metal, dirt, polymeric material, dirty fines, amber fines, or any other unwanted material.

Next, the defective pellets and additional loose contaminants are detected in the batch. The defective pellets contain contaminants embedded within them. For instance, metal pieces, fabric, other polymer materials, or other components may be embedded or adhered to pellets in a manner that makes their separation difficult or impractical. These defective pellets are detected along with additional loose contaminants in the batch that were not removed in the first step of cleaning.

In addition, a magnet may be employed to remove contaminants made of ferrous materials from the batch. These contaminants may be loose in the batch or embedded in pellets. Consequently, the magnet may be inserted in the material stream either before or after the defective pellets are removed. Alternatively, magnets may be employed both before and after the defective pellets are removed.

To help improve the cleaning process, fines may also be removed from the batch of granular materials. As discussed above, "fines" are substances of the same material as the resin pellets but not having a granular or pelletized form. Also called "fluff" or "streamers," fines often are in the shape of strings, hair, or powder. Fines can clog machinery and degrade the throughput of the extruder. By removing fines when the first loose contaminants are removed, the operation of the device for detecting and removing defective pellets can be improved.

Figure 2:
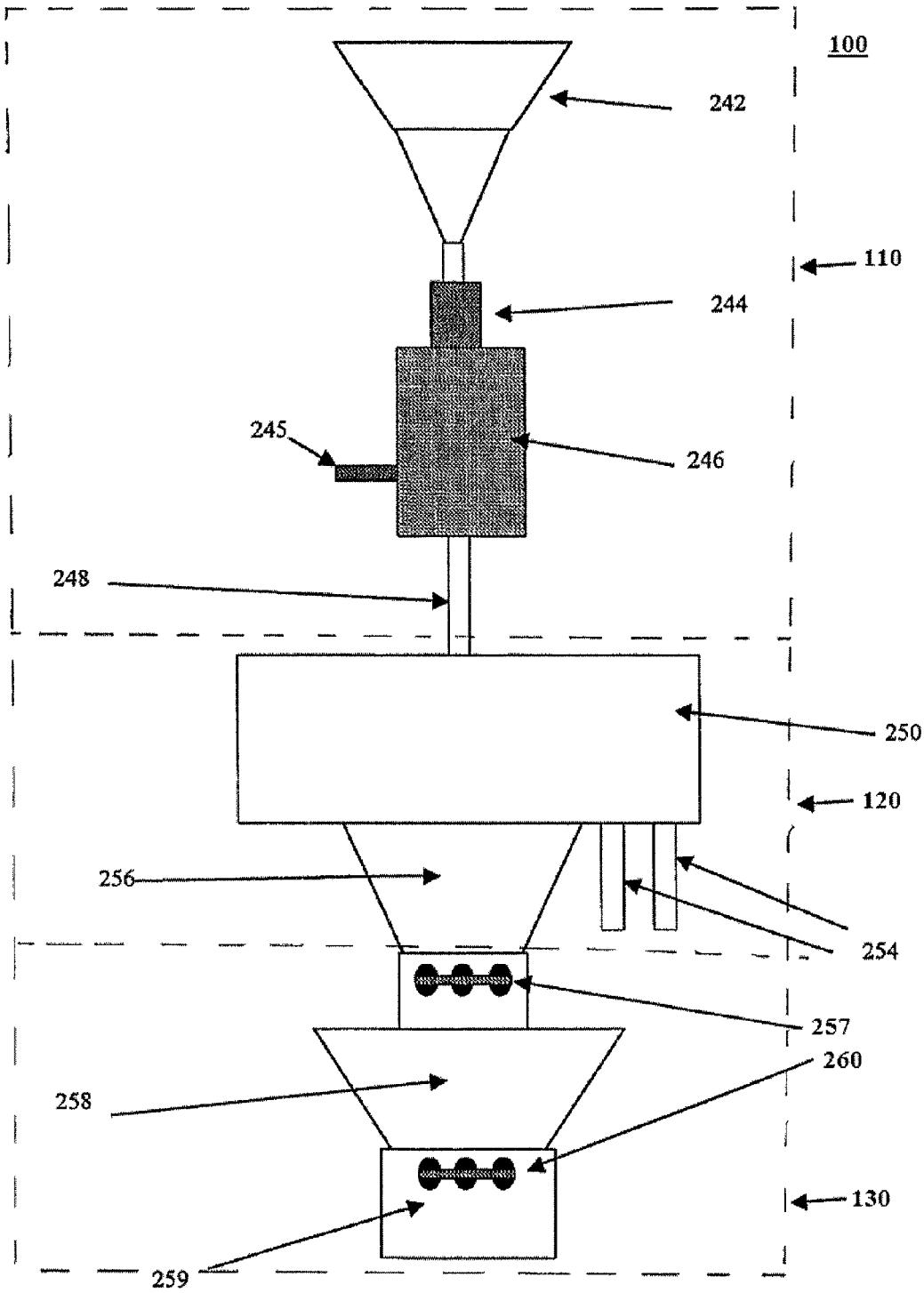
FIG. 2 is a schematic diagram of an apparatus for cleaning a compound in the form of pellets according to the block diagram of FIG. 1.
Figure 3:
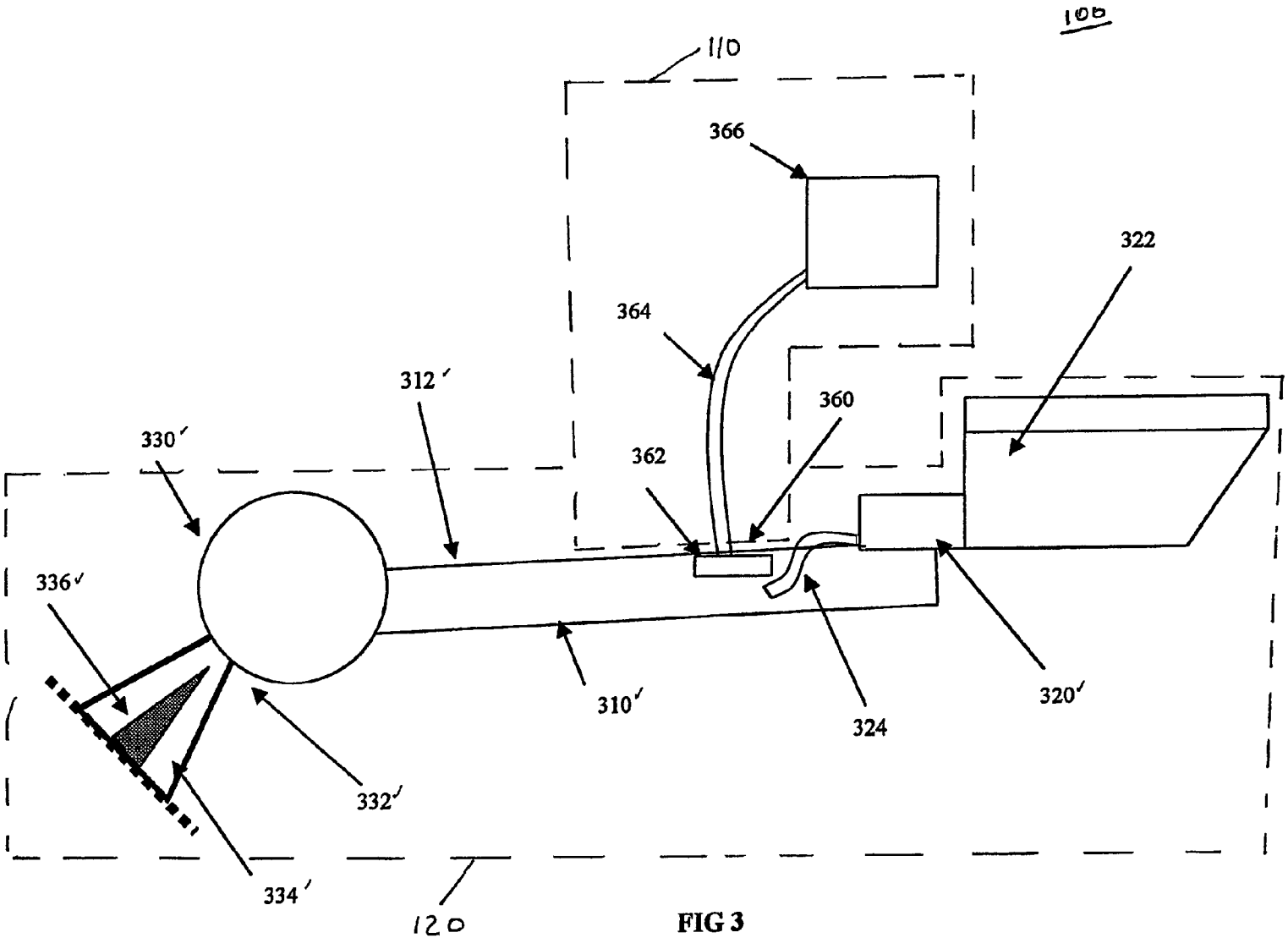
FIG. 3 is a schematic diagram of another embodiment of the apparatus for cleaning a compound in the form of pellets according to the block diagram of FIG. 1.

As herein embodied and illustrated in the block diagram of FIG. 1, a system 100 for cleaning a batch of granular materials to be used in an extrusion process generally comprises three elements or components. A first component 110 removes loose contaminants and fines from within the batch. After component 110, a second component 120 detects and removes undesired pellets and additional loose contaminants from the batch. Finally, a third component 130 removes additional contaminants from the batch that are made of ferrous materials. Although shown in FIG. 1 at the end of the block diagram, component 130 that removes additional ferrous contaminants may be placed between the component 110 and component 120. FIG. 2 and FIG. 3 illustrate preferred embodiments for the block diagram of FIG. 1 and will be described in more detail below.

Component 110 in FIG. 1 generally comprises one or more devices for filtering unwanted contaminants that are mixed within the batch of pellets and that are separably adhered to the pellets themselves. These contaminants may include dust and debris, for example, but generally encompass any particulate having material characteristics that are detrimental or undesirable for the extruded product. In the process, component 110 may also remove loose particles in the form of fines or fluff from the mixture. To do so, component 110 preferably includes the capability of disrupting electrostatic bonds between the pellets and the contaminants and fines, air-washing the batch to lift the contaminants and fines, and providing a circulating air flow to the batch. In this manner, component 110 can remove dust and other particulates that may be adhered to the pellets or that may be arranged loosely within the batch of pellets or granules. Alternately, component 110 may comprise a vacuum. The vacuum would have sufficient strength to remove the contaminants but have insufficient strength to remove a significant quantity of the pellets.

Component 120 in FIG. 1 generally comprises one or more devices for filtering out undesired or defective pellets from the batch of pellets as well as removing other loose contaminants not removed by device 110. The criteria for a pellet being undesired or defective will depend on the extrusion process and the finished product that is being produced. As described in more detail below, undesired or defective pellets in the preferred embodiment typically are pellets having contaminants embedded within or inseparably adhered to them. In other applications, however, defective or undesired pellets may include those that have irregular shapes, dissimilar colors, or other inconsistencies. To decrease the chances of additional contaminates being introduced into the batch of pellets, components 110 and 120 may be placed in close proximity to one another.

The apparatus for selecting or detecting the defective pellets is depicted as a component 123 in FIG. 1. Component 123 may comprise an optical scanner that determines if particles comprising the material include these attributes. Alternatively, component 123 may comprise a mechanical sorting device that may be configured for sorting the particles or pellets by at least one of weight and symmetry. As part of component 120, an optional component 127 may be employed that physically separates the unwanted pellets from the rest of the pellets after they have been selected.

Component 130 in FIG. 1 generally comprises one or more devices for filtering additional contaminants that are mixed within the batch of pellets. The additional contaminants may include small ferrous materials, for example, that are distributed within the batch of pellets or are embedded within them. Preferably, component 130 comprises at least one magnet including a rare earth material such as neodymium-iron-boron, for example. As mentioned, component 130 may be configured to remove the additional contaminants before or after the defective pellets are screened and removed from the batch.

In a preferred embodiment, system 100 is used to remove contaminants from a collection of plastic resin pellets prior to their extrusion for obtaining the insulation of an electrical cable. Consequently, the pellet material may comprise pelletized electrical insulation material suitable for electrical cables, for example, polyethylene, crosslinked polyethylene, and tree-retardant crosslinked polyethylene. The aforementioned materials are exemplary and other types of materials may be used. As stated above, the material may comprise a plurality of loose particles including fines and loose contaminants, a plurality of undesired or defective pellets, and a plurality of desired pellets.

FIG. 2 shows in more detail an apparatus corresponding to system 100. Component 110, which removes contaminants from a batch of granulized materials that includes pellets, may comprise a feeder 244, a rejection port 245, and a remover 246. The granular or pelletized material, for example plastic resin, is transported to upper surge hopper 242 and fed through feeder 244 into remover 246. Remover 246 is configured for removing contaminants, for example fines, dust, and loose particles, from the batch of pellets. A commercially available (and most preferable) means for removing dust and fines and other loose particles from the pellet stream is, for instance, the Pelletron Deduster available from Pelletron Corporation of Lancaster, Pa. This device is described in more detail in U.S. Pat. No. 4,631,124, which is incorporated herein by reference. The precise implementation of remover 246 is not critical for carrying out the present invention, however, an elutriator, an air classifier, or an air aspirator may be employed that may or may not include electrostatic features. Removed fines, dust, and loose particles may be ejected from the material stream through rejection port 245. The material stream is then fed into defective element remover 250 of component 120 through feed chute 248.

Contaminant remover 246 may operate, for example, by breaking electrostatic bonds between loose particles in the compound stream and both desirable and defective pellets. The electrostatic bonds may be broken in order also to remove fines. After electrostatic bonds are disrupted, the compound is air-washed to lift the contaminants and fines. That is, after electrical bonds are broken, air may be used to lift and separate the contaminants and fines from both desirable and defective pellets.

Once the material is air-washed, a circulating air flow may be provided to the batch of materials to remove the loose particles comprising contaminants and fines. As stated above, a Pelletron Deduster from Pelletron Corporation may be used in removing these loose particles. As an alternative, removing the loose contaminants from the batch of materials may be accomplished by applying a vacuum above the materials, for example, as they are fed into the system. The vacuum should have sufficient strength to remove fines and contaminants, for example, from and around the pellets, but having insufficient strength to remove any significant number of the pellets. This may be accomplished by applying the vacuum through a vacuum nozzle above and in front of the pellets as the pellets are being fed into the system.

Component 120, which selects and removes undesired or defective pellets from the batch as well as additional contaminants not removed by component 110, may comprise a defective element remover 250, chutes 254, and a discharge chute 256. The Applicant has perceived that the identification and removal of the defective pellets can be remarkably improved by placing component 120 downstream from component 110. In removing the fines from a stream of pellets, component 110 considerably increases the efficiency of the defective pellets removal since the fines can mask defective pellets during the detection process or can be themselves erroneously detected as good pellets. The precise implementation of defective element remover 250 is not critical for carrying out the present invention. Commercially available devices that may be used for remover 250 include, for instance, most preferably a PELLETSCAN unit from Satake USA Inc. of Houston, Tex. or a UNIPEL®-hc Pellet Contamination Rejector available from SVANTE BJÖRK AB of Kungsbacka, Sweden. U.S. Pat. No. 6,355,897, and the other art discussed in the Background section above, describe various techniques for sorting defective granules or pellets and are incorporated herein by reference. The material may then be sent through discharge chute 256 to component 130 for further processing.

Component 130, which removes additional contaminants from the pellets, may comprise a first ferrous particle remover 257, a lower surge hopper 258, a distribution box 259, and a second ferrous particle remover 260. While remover 246 in component 110 may remove some ferrous particles, other ferrous particles may be too heavy for remover 246 to separate from flow of material. Consequently, component 130 helps to remove additional contaminants from the material stream, particularly those that are iron based.

Ferrous particles remaining in the material may be removed from the material by passing the material through a first ferrous particle remover 257 just before entering the lower surge hopper 258. The material may then be passed through second ferrous particle remover 260 and collected in distribution box 259. Preferably, only second ferrous particle remover 260 is employed, but the number and placement of magnets in the particle stream is virtually unlimited. For example, another ferrous particle remover could be placed further downstream from the second ferrous particle remover 260, for instance on the bottom of the dryer hopper (not shown). First ferrous particle remover 257, second ferrous particle remover 260, and other magnets in the stream may comprise one or more rare earth magnets positioned such that the material passes by at least one rare earth magnet after exiting defective element remover 250. The rare earth magnets may comprise neodymium-iron-boron magnets and may be employed in a grate separator configuration. For example, the magnets may be tubular and encased in stainless steel tubes, the tubes being held in parallel by stringers at each end of the tubes. In the grate configuration, the material may flow more easily through the magnets.

Rare earth magnets consistent with this embodiment of the present invention may comprise, for instance, the Quick-Clean Magnetic Grate Separator type made by Eclipse Magnetics of Sheffield, England and available from McMaster-Carr of Los Angeles, Calif. In the Quick-Clean configuration, magnets are encased in a removable stainless steel sleeve so that the magnets can be easily cleaned. Suitable rare earth magnet configurations have maximum pull on contact of at least 20 lbs, and may be between about 30 lbs. to about 70 lbs. In addition, suitable rare earth magnets may have a strength for example between approximately 7,000 and 11,000 Gauss.

FIG. 3 shows another embodiment of an apparatus for implementing system 100. As shown in the FIG. 3, component 110, which removes contaminants from the particle stream, may comprise a remover 360, a nozzle 362, a hose 364, and a vacuum 366. In addition, component 120, which detects and removes defective or unwanted pellets, may comprise a conveyor 310, a feeder 320, a separator 330, a sorting means 332, a first chute 334, a second chute 336, a cover 312, a container 322, and a mouthpiece 324.

In FIG. 3, conveyor 310 may comprise a conveying belt, an inclined plate, a vibrator and may include a cover 312. Cover 312 may protect the material from environmental contamination. Feeder 320 may comprise container 322 for the material and mouthpiece 324 to feed the material to conveyor 310. The material may then be conveyed further into separator 330 in order to detect defects in the material by sorting particles comprising the material by at least size or weight.

Remover 360 may remove, for example, fines, dust, and loose particles from and around pellets that are conveyed on conveyor 310. Remover 360 may be positioned above conveyor 310 and close to feeder 320 such that fines, for example, may be removed at substantially the same time as the material is fed onto the conveyor 310 and before the detector 330. Remover 360 may be positioned above the conveyor 310, extending under the cover 312, and just after the mouthpiece 324. Nozzle 362 may span the width of conveyor 310 so that a substantial portion of the material fed onto conveyor 310 passes under or in front of nozzle 362. The airflow provided, or the vacuum applied through the vacuum nozzle 360, should be sufficient, for example, to remove fines, dust, and loose particles, but not strong enough to remove any significant number of pellets. The amount of airflow can be selected upon the type of material to be processed. After the material moves through chute 334, it may then be fed into a lower surge hopper (not shown).

Although not shown in FIG. 3, a ferrous particle remover may be employed in the apparatus of FIG. 3 in a manner similar to the apparatus depicted in FIG. 2 to further remove contaminants from the pellet stream.

The principles and practical application of embodiments of the present invention can be further illustrated by the following non-limiting example. In accordance with embodiments of the present invention, system 100 was configured as illustrated in FIG. 2. Tests were carried out to determine the contaminant removal efficiency of this embodiment of the present invention.

Tests were conducted to verify the efficiency of removing contaminants according to preferred embodiments of the present invention. In particular, a cone filter was introduced at the rejection port 245 of a Pelletron Deduster to catch contaminants removed by the Pelletron Deduster for analysis. The Pelletron Deduster was also modified to provide a feed port to introduce the contaminants into the pellet stream immediately above the pellet feeder 244. A bag to collect, for example, rejected pellets and particles from the Pelletscan HR Satake Machine was secured at chutes 254. Also, torpedo rare earth magnets were secured at chutes 254 of the Pelletscan HR Satake machine to collect any ferrous particles rejected by the Satake machine. The torpedo magnet is designed to fit inside a conveying tube, and is shaped like a torpedo. The material flows between the magnet and the walls of the tube.

While a pellet stream of TRXLPE pellets, for example, intended for extrusion for electrical cable insulation was run through the Pelletron Deduster, contaminant particles of various colors and geometries/shapes were introduced into the pellet stream via the feed port. All contaminant particles were nominally 0.025 inches in at least one dimension. The contaminant particles consisted of 10 Iron particles, 10 Aluminum particles, 10 red PVC particles, 10 white Nylon particles, 10 blue HDPE particles, 10 cellulose particles, 10 black EVA particles, 10 orange EPR particles, and 8 green PBT particles. Fines from the TRXLPE pellets were also present.

The pellet stream with contaminants was run through the Pelletron Deduster, the Satake Pelletscan HR and past the rare earth magnets. The Pelletron Deduster removed not only the majority of the fines from the pellet stream, but also other contaminants, including Aluminum particles. Overall, approximately 99% of the contaminants introduced were removed from the pellet stream with the present embodiment. This compares with only approximately 40% of the contaminants being removed with only the Pelletscan HR Satake machine or a UNIPEL®-hc Pellet Contamination Rejector machine used alone. Table 1 shows the complete data for this test.

TABLE 1

| Particle Type | Item # | Nominal Particle Size | # Introduced | # Found Pelletron | # Found Satake 1st Pass | # Found Satake 2nd Pass | # Found on Magnet | Total Found Satake + Pelletron + Magnet | Hit Rate (%) |
|---|---|---|---|---|---|---|---|---|---|
| Iron | 1 | 0.025" | 10 | 0 | 4 | 4 | 2 | 10 | 100% |
| Aluminum | 2 | 0.025" | 10 | 10 | 0 | 0 | 0 | 10 | 100% |
| PVC (red) | 3 | 0.025" | 10 | 9 | 0 | 0 | 0 | 9 | 90% |
| Nylon (white) | 4 | 0.025" | 10 | 10 | 0 | 0 | 0 | 10 | 100% |
| HDPE (Blue) | 5 | 0.025" | 10 | 10 | 0 | 0 | 0 | 10 | 100% |
| Cellulose | 6 | 0.025" | 10 | 10 | 0 | 0 | 0 | 10 | 100% |
| EVA (black) | 7 | 0.025" | 10 | 10 | 0 | 0 | 0 | 10 | 100% |
| EPR (orange) | 8 | 0.025" | 10 | 10 | 0 | 0 | 0 | 10 | 100% |
| PBT (green) | 9 | 0.025" | 8 | 8 | 0 | 0 | 0 | 8 | 100% |
| Total | | | 88 | 77 | 4 | 4 | 2 | 87 | 99% |

The foregoing description has been limited to a specific embodiment of this invention. It will be apparent, however, that various variations and modifications may be made to the invention, with the attainment of some or all of the advantages of the invention. For example, while the invention has been disclosed primarily in terms of cleaning plastic pellets for the extrusion of the insulation of an electrical cable, it is applicable to many other uses in the art. Particles other than pellets and materials other than plastic are within the scope of the present invention. It is the object of the appended claims to cover these and such other variations and modifications as come within the true spirit and scope of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for cleaning a batch of granular materials to be used in extruding a product, the batch including pellets, defective pellets, and loose particles, comprising:

removing, using a deduster, a portion of the loose particles from the batch, including removing loose contaminants and fines that are separable from both the pellets and the defective pellets, the fines being of the same material as the pellets, and the loose contaminants having material characteristics that are undesirable for the product;

after the removing of a portion of the loose particles, including fines and contaminants, detecting in the batch the defective pellets and additional loose contaminants using a pellet sorter, the defective pellets being inextricably attached to embedded contaminants;

preventing any ambient particles from mixing with the batch as the batch passes between the deduster and the pellet sorter using a chute coupling the deduster and the pellet sorter, the chute being enclosed along its entire length; and after the detecting the defective pellets and the additional loose contaminants, removing the defective pellets and the additional loose contaminants from the batch.

2. The method of claim 1, further comprising removing further contaminants containing ferrous material from the batch.

3. The method of claim 2, wherein the removing of further contaminants containing ferrous material occurs before the removing of the defective pellets from the batch.

4. The method of claim 2, wherein the removing of further contaminants containing ferrous material occurs after the removing of the defective pellets from the batch.

5. The method of claim 2, wherein the removing of further contaminants containing ferrous material comprises using at least one magnet.

6. The method of claim 5, wherein the at least one magnet comprises a rare earth material.

7. The method of claim 6, wherein the rare earth material comprises at least neodymium-iron-boron.

8. The method of claim 1, wherein the removing of a portion of the loose particles from the batch includes removing clean fines.

9. The method of claim 1, wherein the removing of a portion of the loose particles from the batch comprises:

disrupting electrostatic bonds between the loose particles and the pellets and defective pellets;

air-washing the batch to lift the loose particles; and providing a circulating air flow to the batch to remove the loose particles.

10. The method of claim 1, wherein the removing of a portion of the loose particles comprises applying a vacuum, the vacuum having sufficient strength to remove the loose particles but having insufficient strength to remove a significant quantity of the pellets.

11. The method of claim 1, wherein the detecting of the defective pellets and additional loose contaminants comprises optically scanning the batch for evidence of the embedded contaminants.

12. The method of claim 1, wherein the detecting of the defective pellets and additional loose contaminants comprises mechanical sorting.

13. The method of claim 12, the detecting of the defective pellets and additional loose contaminants further comprises sorting the batch of pellets by at least one of weight and geometry.

14. The method of claim 1, wherein the pellets are used to extrude at least one of polyethylene, crosslinked polyethylene, tree-retardant crosslinked polyethylene, linear low-density polyethylene, propylene/ethylene thermoplastic copolymers, ethylene/vinyl acetate (EVA) copolymers, ethylene/methyl acrylate (EMA) copolymers, ethylene/ethyl acrylate (EEA) copolymers, ethylene/butyl acrylate (EBA) copolymers, ethylene/a.-olefin copolymers, and polypropylene.

15. The method of claim 1, wherein the pellets are extruded into the insulation layer of an electrical cable.

* * * * *

UNITED STATES PATENT AND TRADEMARK OFFICE

CERTIFICATE OF CORRECTION

PATENT NO. : 8,511,474 B2
APPLICATION NO. : 10/565201
DATED : August 20, 2013
INVENTOR(S) : Andrew Maunder It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1183 days.

Signed and Sealed this
Twenty-seventh Day of January, 2015

Michelle K. Lee

Michelle K. Lee
*Deputy Director of the United States Patent and Trademark Office*